US008156997B1

(12) United States Patent
Carter et al.

(10) Patent No.: US 8,156,997 B1
(45) Date of Patent: Apr. 17, 2012

(54) HEATED AND COOLED COMPRESSED AIR DEVICE AND METHOD

(75) Inventors: Melvin O. Carter, St. Augustine, FL (US); Darren A. Carter, Jacksonville, FL (US); Kevin A. Carter, St. Augustine, FL (US); Fred M. Williams, Jacksonville, FL (US)

(73) Assignee: TMS Company LLC, Jacksonville, FL (US)

( * ) Notice: Subject to any disclaimer, the term of this patent is extended or adjusted under 35 U.S.C. 154(b) by 1878 days.

(21) Appl. No.: 11/036,777

(22) Filed: Jan. 15, 2005

(51) Int. Cl.
*F25B 29/00* (2006.01)

(52) U.S. Cl. ..... 165/47; 165/46; 165/48.1; 165/61; 165/63; 165/64; 165/75; 165/103; 165/119; 417/243; 62/259.3; 62/326; 62/420; 219/211; 219/386

(58) Field of Classification Search ..... 165/47, 165/46, 48.1, 61, 63, 64, 75, 103, 119; 417/243; 62/420, 326, 259.3; 219/211, 386
See application file for complete search history.

(56) References Cited

U.S. PATENT DOCUMENTS

| | | | | |
|---|---|---|---|---|
| 702,915 | A | 6/1902 | Bocker | |
| 3,041,842 | A * | 7/1962 | Heinecke | 62/310 |
| 3,245,396 | A * | 4/1966 | Goss | 126/109 |
| 3,265,301 | A * | 8/1966 | Amdur et al. | 165/222 |
| 3,305,000 | A * | 2/1967 | Bullen et al. | 219/400 |
| 3,760,842 | A * | 9/1973 | Mikiya | 137/557 |
| 3,869,871 | A | 3/1975 | Rybalko et al. | |
| 3,910,062 | A * | 10/1975 | Rojas | 62/406 |
| 4,026,299 | A | 5/1977 | Sauder | |
| 4,146,933 | A | 4/1979 | Jenkins et al. | |
| 4,204,613 | A | 5/1980 | Terzian et al. | |
| 4,662,433 | A | 5/1987 | Cahn et al. | |
| 4,691,762 | A | 9/1987 | Elkins et al. | |
| 4,964,282 | A | 10/1990 | Wagner | |
| 5,284,202 | A * | 2/1994 | Dickey et al. | 417/243 |
| 5,303,652 | A * | 4/1994 | Gasparrini et al. | 101/425 |
| 5,438,707 | A | 8/1995 | Horn | |
| 5,533,354 | A | 7/1996 | Pirkle | |
| 5,542,413 | A | 8/1996 | Horn | |
| 5,858,064 | A | 1/1999 | Delp, II | |
| 5,927,399 | A * | 7/1999 | Kazakis et al. | 417/243 |

(Continued)

FOREIGN PATENT DOCUMENTS

GB 1379544 A * 1/1975

OTHER PUBLICATIONS

AirVest™ and Airchaps™, http://www.pcm-solutions.com/coolingvests.html.

(Continued)

*Primary Examiner* — John Ford
(74) *Attorney, Agent, or Firm* — Foley & Lardner LLP

(57) ABSTRACT

A device and method are disclosed for producing heated and/or cooled compressed air. The device may include a conventional air compressor, one or more filter stages to dry and purify the compressed air, a heat exchanger assembly including a heat exchanger enclosure with a heat exchange coil surrounded by ice or hot water for cooling or heating the compressed air, and an air distribution manifold to supply the temperature-controlled and filtered air to users. In a preferred embodiment, ice is used to cool the compressed air, and the cooled compressed air is supplied to protective gear worn by athletes to cool the athletes during rest periods.

12 Claims, 8 Drawing Sheets

U.S. PATENT DOCUMENTS

| | | | | |
|---|---|---|---|---|
| 6,009,713 | A | 1/2000 | Horn | |
| 6,099,617 | A | 8/2000 | Bennett | |
| 6,119,474 | A | 9/2000 | Augustine et al. | |
| 6,125,645 | A | 10/2000 | Horn | |
| 6,167,956 | B1 * | 1/2001 | Bostedo et al. | 417/243 |

OTHER PUBLICATIONS

ITW Vortec Personal Air Conditioners™, http://www.itwvortec.com/personal_air.php.

* cited by examiner

HEATED AND COOLED COMPRESSED AIR DEVICE AND METHOD

FIELD OF THE INVENTION

The present invention relates generally to a device and method for producing heated and/or cooled compressed air and, more particularly, to a device and method for producing heated and/or cooled compressed air that is well suited for use in heating and/or cooling the human body.

BACKGROUND OF THE INVENTION

Temperature controlled air is widely used for a variety of purposes. For example, cold air is used for refrigeration, or to provide a comfortable environment for the human body when the body is at an elevated temperature due to physical exertion or when the body is in a warm environment. Similarly, heated air can be used to provide a comfortable environment in cold climates.

Compressed air is also widely used for a variety of purposes. For example, compressed air can be used to operate power tools or to inflate tires. In some applications, it can be especially advantageous to provide compressed air whose temperature is controlled by heating or cooling the compressed air. For example, compressed air forced into a space will tend to expand and escape through any available openings, and the resulting movement of the air provides increased cooling or heating compared to uncompressed air. The pressurization also permits the air to be blown through small airways, channels or tubes, which can be useful for delivering the air to particular locations or through materials Commercial air compressors typically produce compressed air at a temperature of about 100° Fahrenheit (all degrees are in Fahrenheit) plus the ambient temperature. For example, if the ambient temperature is 75°, the temperature of the compressed air will be approximately 175° as it leaves the compressor.

Existing technology and devices, known as dryers or coolers, are typically able to cool compressed air about 75°-80°. Assuming the input compressed air is at about 175°, after conventional cooling the compressed air will still be around 100° F. Because this temperature is approximately the same as the temperature of the human body, conventionally cooled compressed air cannot adequately cool the human body. Conventionally cooled compressed air is particularly inadequate when the ambient temperature or environment is warm or hot (for example, an ambient temperature of 85° or higher).

Thus, there is a need for a device and method which can provide temperature controlled compressed air economically and reliably. What is further needed is a device and method that can be configured to provide either heated or cooled compressed air, while simultaneously drying and cleaning the heated or cooled compressed air in a wide range of environmental conditions. What is further needed is a portable device that can provide temperature controlled compressed air that can be applied to protective gear, such as shoulder pads, or to garments to modulate the body temperature of athletes or other persons working in extreme environmental conditions.

SUMMARY OF THE INVENTION

An exemplary embodiment of the invention relates to a device and method for economically and reliably providing temperature controlled and filtered compressed air, able to provide either warmed or cooled air (although not both at the same time).

In a preferred embodiment, the device includes an air compressor coupled to a first air filter, with the resulting filtered air passed through a heat exchanger assembly having a heat exchanger coil positioned in a heat exchanger enclosure containing either ice or hot water (depending on whether cooling or heating is desired), with the resulting heated or cooled filtered air passed through a second air filter which is coupled to an output manifold that provides a plurality of individual air supply lines. However, it is not required that two air filters are used, and in an appropriate case a device according to the invention may include only a single air filter.

In a preferred embodiment of the invention, the device further comprises a bypass tube and bypass valve so that a portion of the compressed air passing through the heat exchanger assembly can be diverted through the bypass tube instead of through the heat exchanger coil, to reduce the heating or cooling of the compressed air to adjust the temperature of the compressed air.

In a preferred embodiment of the invention, the heat exchanger assembly includes an electric heating element positioned within the heat exchanger enclosure to provide continuous heating of water surrounding the heat exchange coils.

In a preferred embodiment of the invention, the first and second air filters are of the coalescing type, and the second air filter provides a higher level of filtration than the first air filter.

In a preferred embodiment of the invention, each individual air supply line is formed of a coiled flexible plastic tube, and includes its own regulator and shutoff valve. In a particularly preferred embodiment, each individual air supply line is adapted to be coupled to provide air flow to protective gear (such as shoulder pads) or a garment (such as a jacket).

In a preferred embodiment of the invention, the air compressor and the heat exchanger assembly are each mounted on wheels and provided with handles and quick-connect fittings for easy transportation and setup.

In a preferred embodiment of the invention, the output manifold is formed as an elongated tube that can be strapped to the back of a bench for use by athletes during athletic contests.

Other principal features and advantages of the invention will become apparent to those skilled in the art upon review of the following drawings, the detailed description, and the appended claims.

DETAILED DESCRIPTION OF THE PREFERRED EMBODIMENTS

Figure 1:
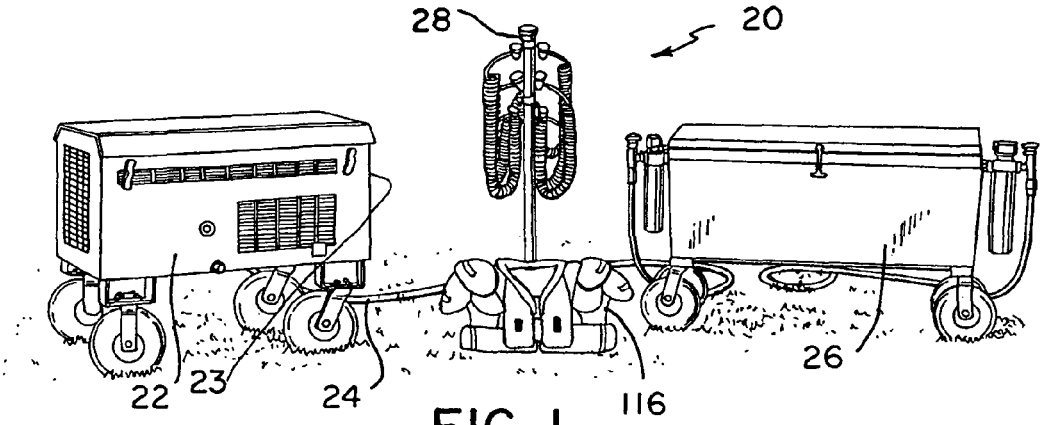
FIG. 1 is a perspective view of the major components of an exemplary device for producing and applying heated and/or cooled compressed air according to the invention.

Referring to the figures, FIG. 1 is a perspective view of the components of an exemplary device 20 for producing and applying heated and/or cooled compressed air according to the invention, indicated generally at 20. The device 20 includes a conventional air compressor 22 having an output port 23 for supplying compressed air, for example a gas or electric air compressor such as the Viper 80 model sold by Vanair Manufacturing, Inc. of New Buffalo, Mich. The air compressor 22 is preferably able to deliver compressed air at a pressure of about 150 PSI (pounds per square inch) at a flow rate of about 185 CFM (cubic feet per minute).

The device 20 includes a compressed air line 24 extending from the air compressor output port 23 to a heat exchanger assembly indicated generally at 26. Another compressed air line 24 extends from the heat exchanger assembly 26 to an output manifold assembly indicated generally at 28. All compressed air lines preferably include quick-connect fittings for ease of assembly and disassembly, although this is not required. The output manifold assembly 28 is configured to supply temperature controlled compressed air to a user, for example an athlete wearing protective gear 116 such as shoulder pads.

Figure 2:
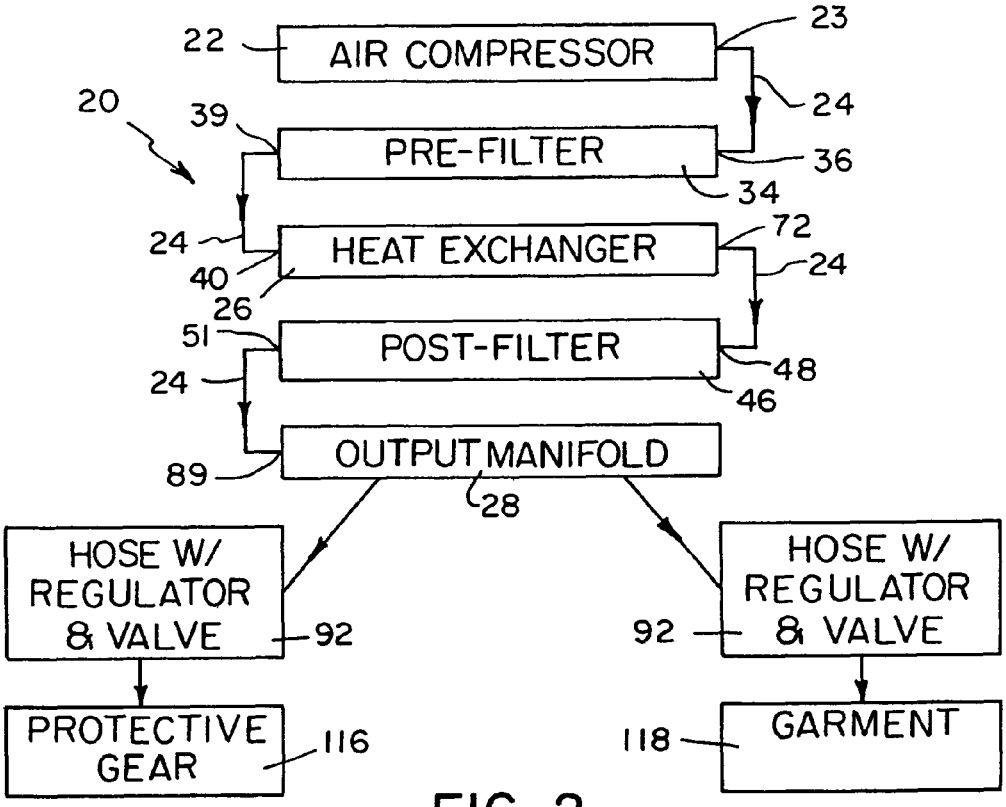
FIG. 2 is a schematic block diagram of an exemplary device for producing and applying heated and/or cooled compressed air according to the invention.

FIG. 2 is a schematic block diagram of an exemplary device for producing and applying heated and/or cooled compressed air according to the invention. The device 20 includes an air compressor 22 able to supply compressed air through a compressed air line 24 to the input port 36 of a pre-filter assembly 34. The pre-filter assembly 34 preferably provides initial filtering and drying of the compressed air from the air compressor 22.

The pre-filter assembly 34 includes an output port 39 that is coupled to the input port 70 of a heat exchanger assembly 26. The heat exchanger assembly 26 is preferably able to be configured to provide either cooling or heating of the compressed air as it passes through the heat exchanger assembly 26.

The heat exchanger assembly 26 has an output port 72 that is coupled to the input port 48 of a post-filter assembly 46. The post-filter assembly 46 preferably provides final filtering and drying of the heated or cooled compressed air from the heat exchanger assembly 26.

The post-filter assembly 46 has an output port 51 that is connected through a compressed air line 24 to an output manifold assembly 28. The output manifold assembly 28 provides the filtered, dried and heated or cooled compressed air to a plurality of individual air supply hose assemblies 92. Each individual air supply hose assembly 92 preferably includes an individual regulator and valve, allowing individual control of temperature controlled air that can be applied to protective gear 116, for example shoulder pads, or to a garment 118, for example a jacket.

Figure 3:
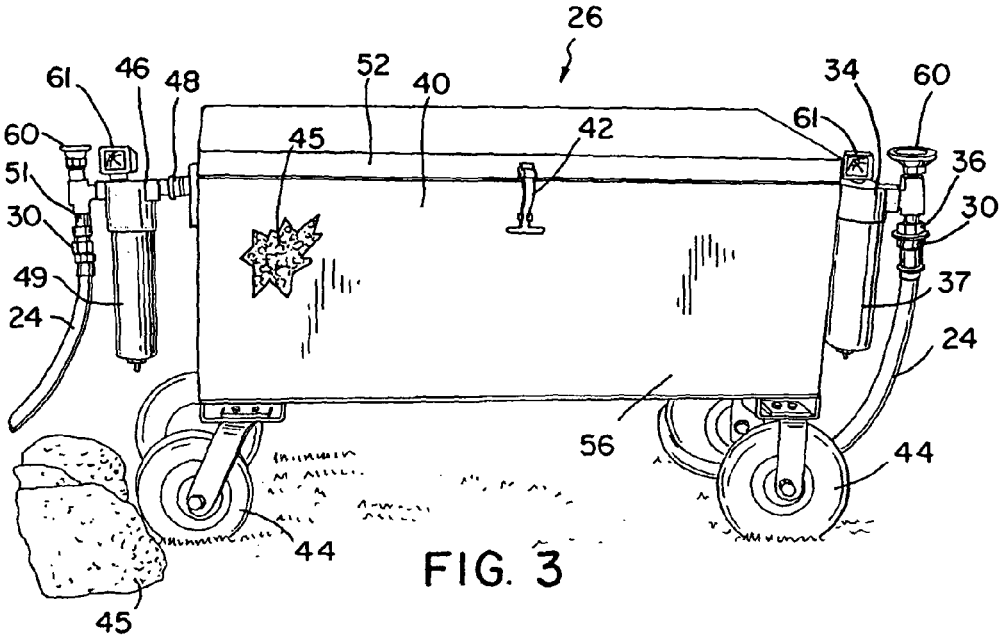
FIG. 3 is a front view of an exemplary heat exchanger assembly according to the invention in a closed position and configured to provide cooling.
Figure 4:
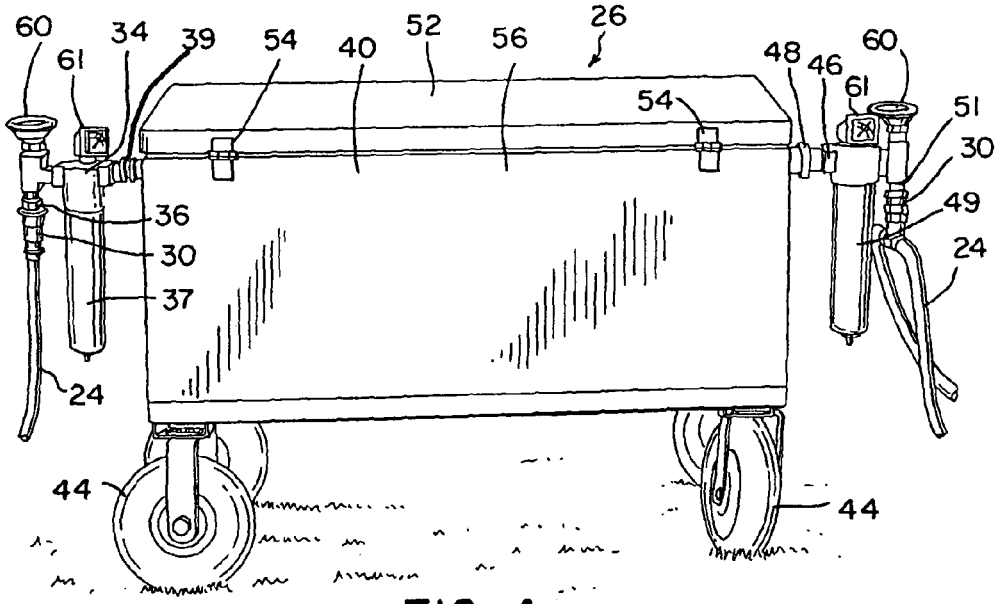
FIG. 4 is a rear view of an exemplary heat exchanger assembly according to the invention in a closed position.

FIG. 3 is a front view of an exemplary heat exchanger assembly 26 according to the invention in a closed position and configured to provide cooling. FIG. 4 is a rear view of the exemplary heat exchanger assembly 26 in a closed position. The heat exchanger assembly 26 preferably includes a quick-connect fitting 30 for easy connection and disconnection of the compressed air line 24 to the input port 36 of the pre-filter assembly 34.

The pre-filter assembly 34 preferably includes a temperature gauge 60 displaying the temperature of the compressed air at the pre-filter, a pre-filter input port 36, a pre-filter filter enclosure 37 that surrounds pre-filter filter media 38 (not shown), a pressure differential gauge 61, and a pre-filter output port 39. A preferred pre-filter assembly 34 includes a coalescing filter such as the Grade 10 H-Series filter sold by Parker Filtration of Cleveland, Ohio.

The heat exchanger assembly 26 includes a heat exchanger enclosure 40 which is preferably an insulated box having a lid 52 with a latch 42, hinges 54, side walls 56, and a floor 58. The heat exchanger enclosure 40 is preferably mounted on wheels 44 and includes one or more handles 62 for ease of transportation. Suitable dimensions for the heat exchanger enclosure are 48"×22"×22."

The lid 52, side walls 56, and floor 58 of the enclosure are preferably made of materials that are suitably durable and rigid to contain water and ice, and are preferably insulated to retain heat and cold, similar to a large ice chest. When used for cooling compressed air, ice 45 will ordinarily be placed in the heat exchanger enclosure 40. When used for heating compressed air, hot water will ordinarily be placed in the heat exchanger enclosure 40.

On the other side of the heat exchanger enclosure 40 is the post-filter assembly 46. The post-filter assembly 46 includes a temperature gauge 60 displaying the temperature of the compressed air at the post-filter, an input port 48, a post-filter enclosure 49 that surrounds post-filter media 50 (not shown), a pressure differential gauge 61, and a post-filter output port 51. A preferred post-filter assembly 46 includes a coalescing filter such as the Grade 6 H-Series filter sold by Parker Filtration of Cleveland, Ohio.

The post-filter assembly 46 preferably provides finer filtration that the pre-filter assembly, since the air passing through the post-filter assembly has already been filtered by the pre-filter. The post-filter assembly 46 and the pre-filter assembly 34 are each preferably provided with a drain to allow water that builds up in the filter media to escape. The pre-filter assembly 34 and post-filter assembly are used to remove solid contaminants and other impurities, oils, and moisture from the air, preferably resulting in 99.99% medical grade air.

The pressure differential gauges 61, if used, display the pressure differentials across the pre-filter and post-filter. If the pressure differential across either filter is either higher or lower than the expected differential, this indicates that the filter is clogged or perforated, or otherwise malfunctioning and should be serviced.

Figure 5:
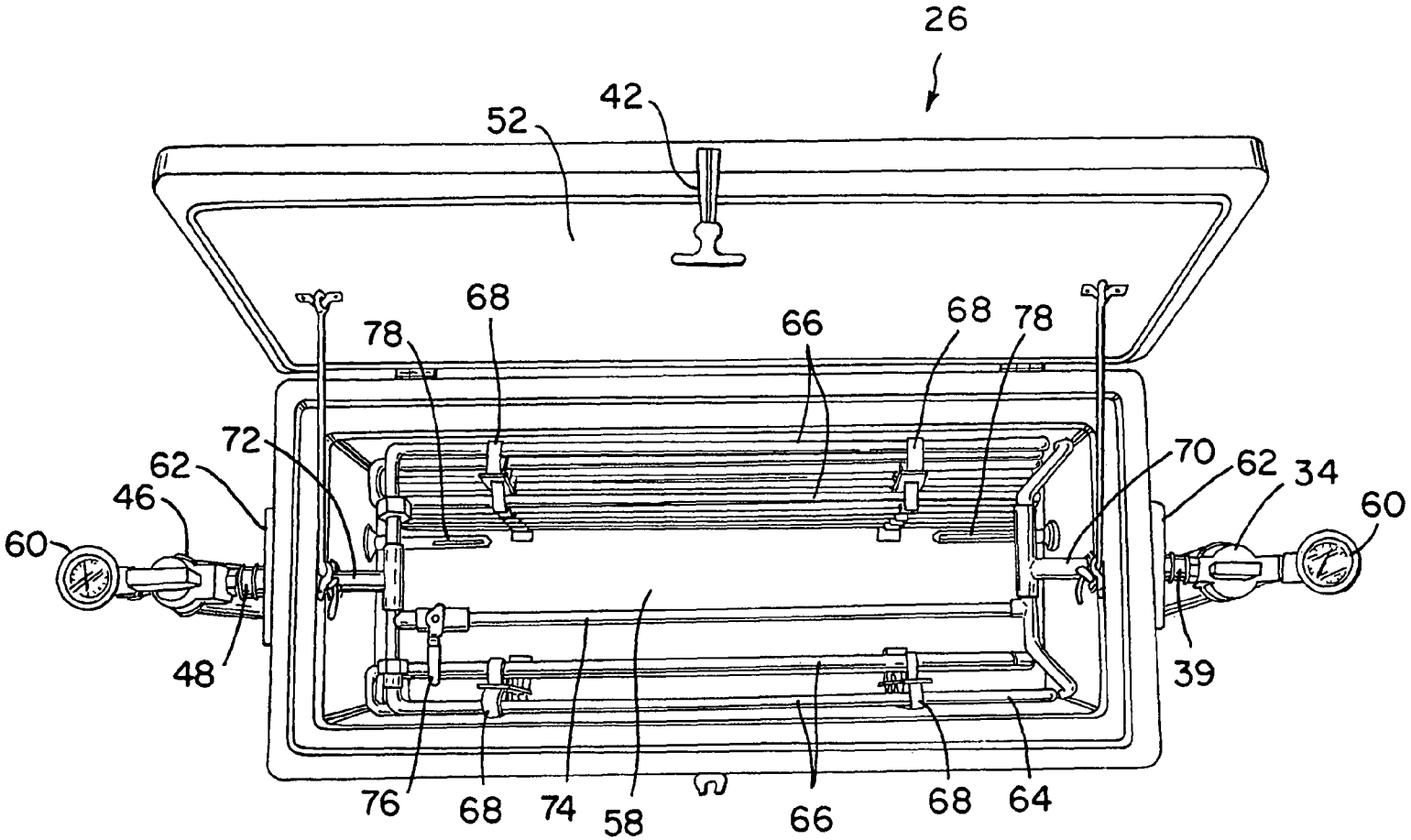
FIG. 5 is a top view of an exemplary heat exchanger assembly according to the invention in an open position prior to being configured to provide either cooling or heating.

FIG. 5 is a top view of the exemplary heat exchanger assembly 26 prior to being configured to provide either cooling or heating, with the lid 52 open to reveal the internal details of the heat exchanger assembly 26.

The output port 39 of the pre-filter assembly 34 is connected to the input port 70 of heat exchange tubing 64 located within the heat exchanger enclosure 40. The heat exchange tubing 64 extends from the input port 70 to an output port 72 which is connected to the input port 48 of the post-filter assembly 46. The heat exchange tubing 64 includes one or more heat exchange coils 66 mounted on heat exchange coil supports 68.

The heat exchange tubing 64 and coils 66 are preferably formed of metal tubing having a high thermal conductivity, such as copper tubing. A suitable heat exchange tubing material is ⅞" OE ACR copper refrigeration tubing. The heat exchange tubing 64 and the heat exchange coil supports 68 are preferably durable enough to withstand thermal cycling and the impact of hot water or ice being poured into the heat exchanger enclosure 40. The effective diameter of the heat exchange tubing 64 is preferably large enough to handle the flow rate of the air compressor 22, for example 185 CFM. The heat exchange tubing 64 and other components of the heat exchanger assembly 26 that carry compressed air are preferably chosen to be strong enough to withstand the pressure of the compressed air supplied by the air compressor 22, for example 150 PSI.

When used to provide cooling, the heat exchanger enclosure 40 is normally filled before use with ice and/or cold water to at least partially surround the heat exchange coils 66. After use, the melted ice must be drained, for example using drains 80. In some applications, it may be necessary to replenish the ice during operation.

When used to provide heating, the heat exchanger enclosure 40 is normally filled with hot water to at least partially surround the heat exchange coils 66. Heater elements 78, for example immersion type heating coils such as the Vulcan 1500W model sold by Vulcan Electric Co. of Porter, Me., can be positioned at the bottom of the heat exchanger enclosure 40 and energized to keep the water hot. Water is added to the container and the heater elements 78 can be used to heat the water to a temperature of approximately 190°. By controlling the amount of electrical power applied to the heater elements 78, the water temperature and thus the temperature of the output air can be adjusted.

The heat exchange tubing 64 preferably includes a bypass tube 74 that has a bypass valve 76, although this is not required. When the bypass valve 76 is closed, all the air flowing through the heat exchange tubing 64 passes through the heat exchange coils 66. When the bypass valve 76 is opened, some of the air can pass through the bypass tube 74 instead of through the heat exchange coils 66. Thus, by opening or closing the bypass valve 76 the amount of air that flows through the heat exchange coils 66 can be adjusted to adjust the final temperature of the output air from the heat exchanger enclosure 40. In practice, the heat exchanger assembly 26 has been demonstrated to reduce the temperature of the compressed air more than 100° from the input port 70 to the output port 72 when used for cooling.

Figure 6:
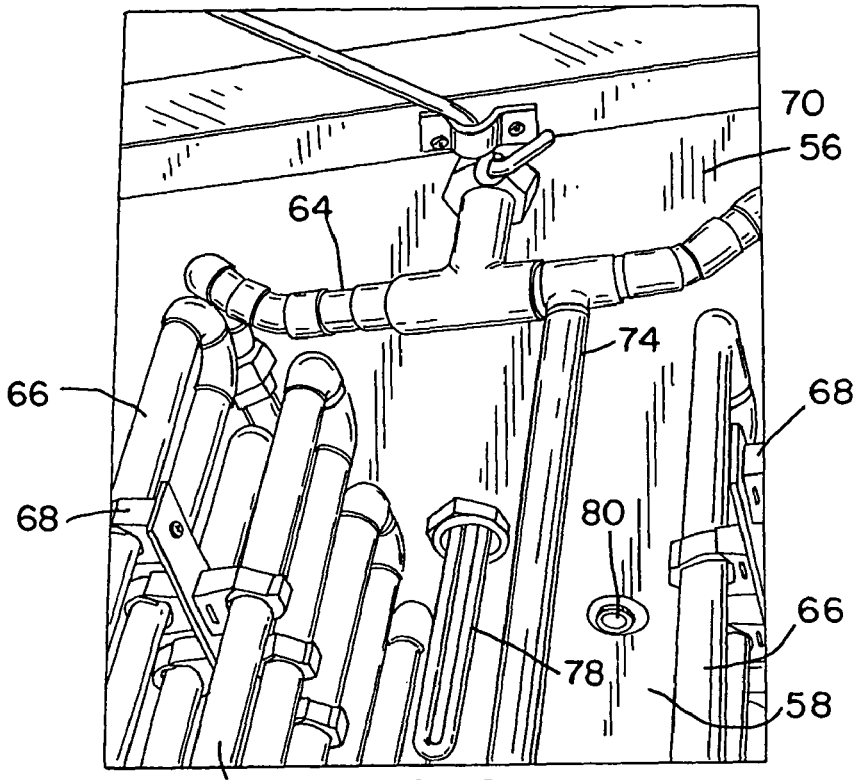
FIG. 6 is a perspective view of the interior details of one end of an exemplary heat exchanger assembly according to the invention in an open position prior to being configured to provide either cooling or heating.

FIG. 6 shows the interior details of one end of the exemplary heat exchanger enclosure 40. As shown in FIG. 6, the heat exchanger enclosure 40 preferably includes one or more drains 80 so that water can be emptied from the enclosure after use.

Figure 7:
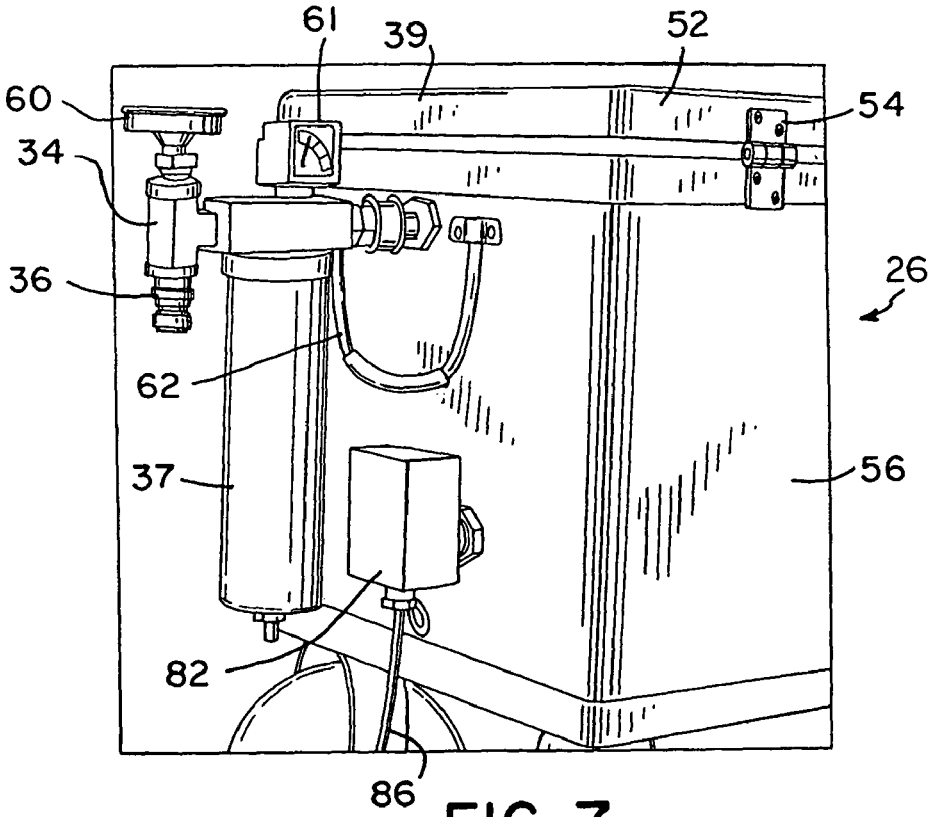
FIG. 7 is a perspective view of the exterior details of one end of an exemplary heat exchanger assembly according to the invention in a closed position.

FIG. 7 shows the exterior details of one end of the exemplary heat exchanger assembly 26. In particular, FIG. 7 shows the heater control enclosure 82 mounted at the end of the heat exchanger enclosure 40.

Figure 8:
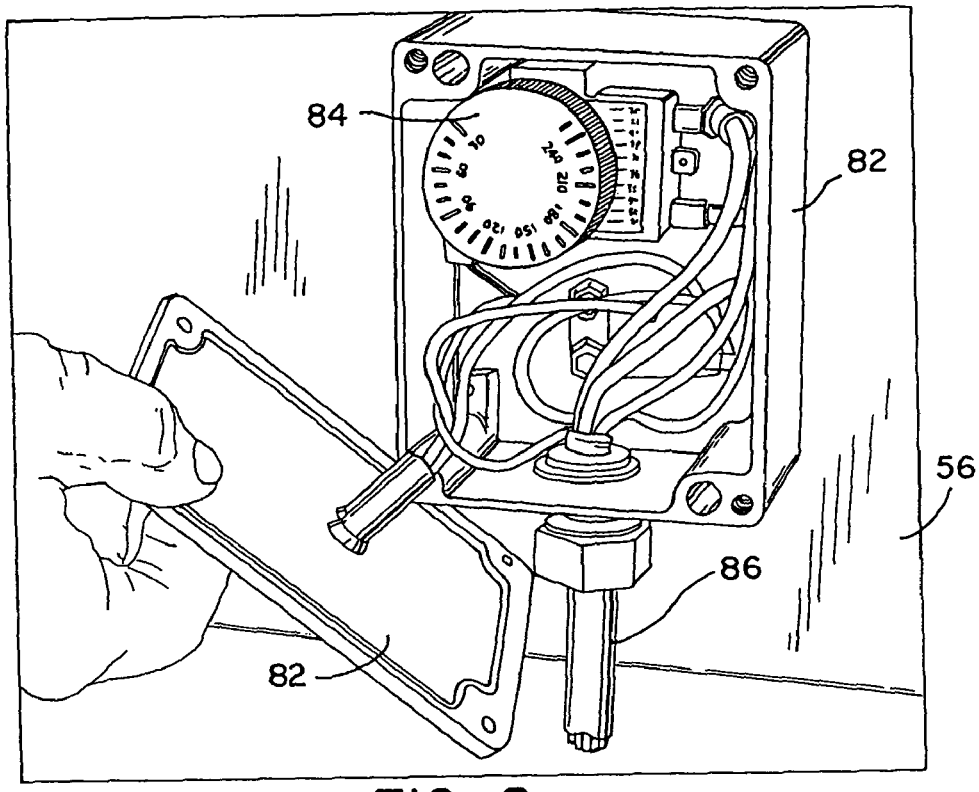
FIG. 8 is a perspective view of the interior details of an exemplary heater control enclosure for a heat exchanger assembly according to the invention.

FIG. 8 shows the interior details of the exemplary heater control enclosure 82. The heater control enclosure 82 that can be opened to reveal the heater controller 84 which controls the application of electrical power from the power supply line 86 to the heater element 78. A suitable heater controller 84 can be obtained from Vulcan Electric Co. of Porter, Me. This allows the output of the heater element 78 to be controlled in order to adjust the temperature of the water inside the enclosure when the system is used to provide heated compressed air.

Figure 9:
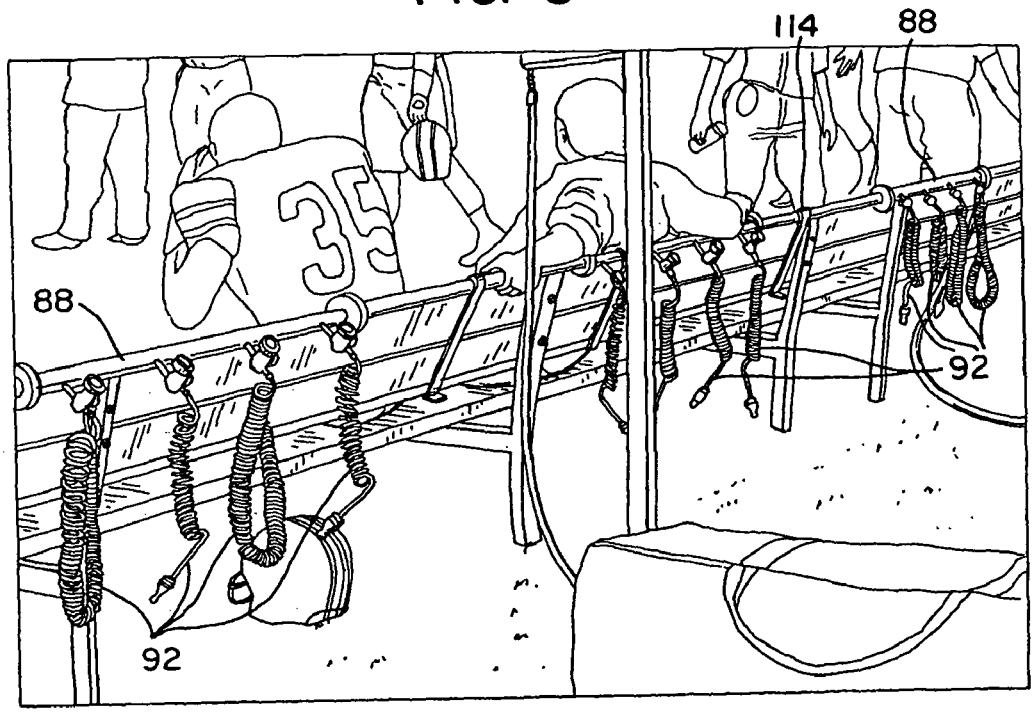
FIG. 9 is a perspective view of an exemplary air distribution manifold assembly mounted to a bench for use by athletes during a sporting event.

FIG. 9 shows a typical application of an exemplary air distribution manifold assembly 88 according to the invention for use by athletes during a sporting event. The air distribution manifold 88 is preferably strapped to the rear of a bench 90 using one or more mounting straps 114. Each air distribution manifold includes a plurality of individual air supply hose assemblies 92.

Figure 10:
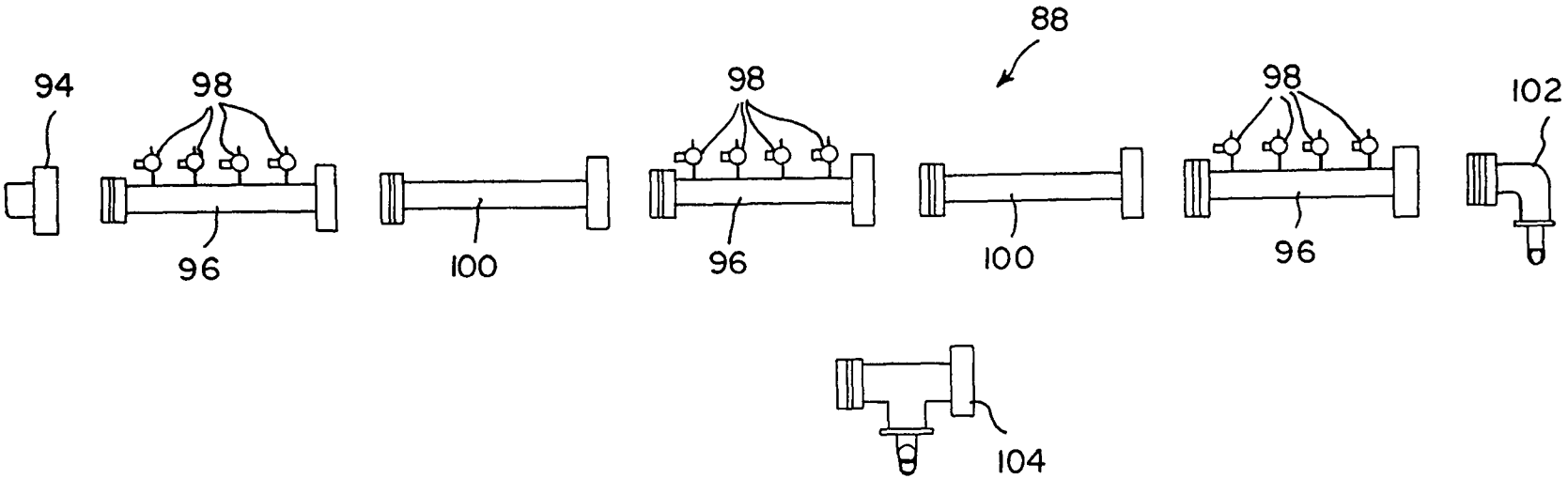
FIG. 10 is an exploded view of an exemplary air distribution manifold of the type shown in FIG. 9.
Figure 11:
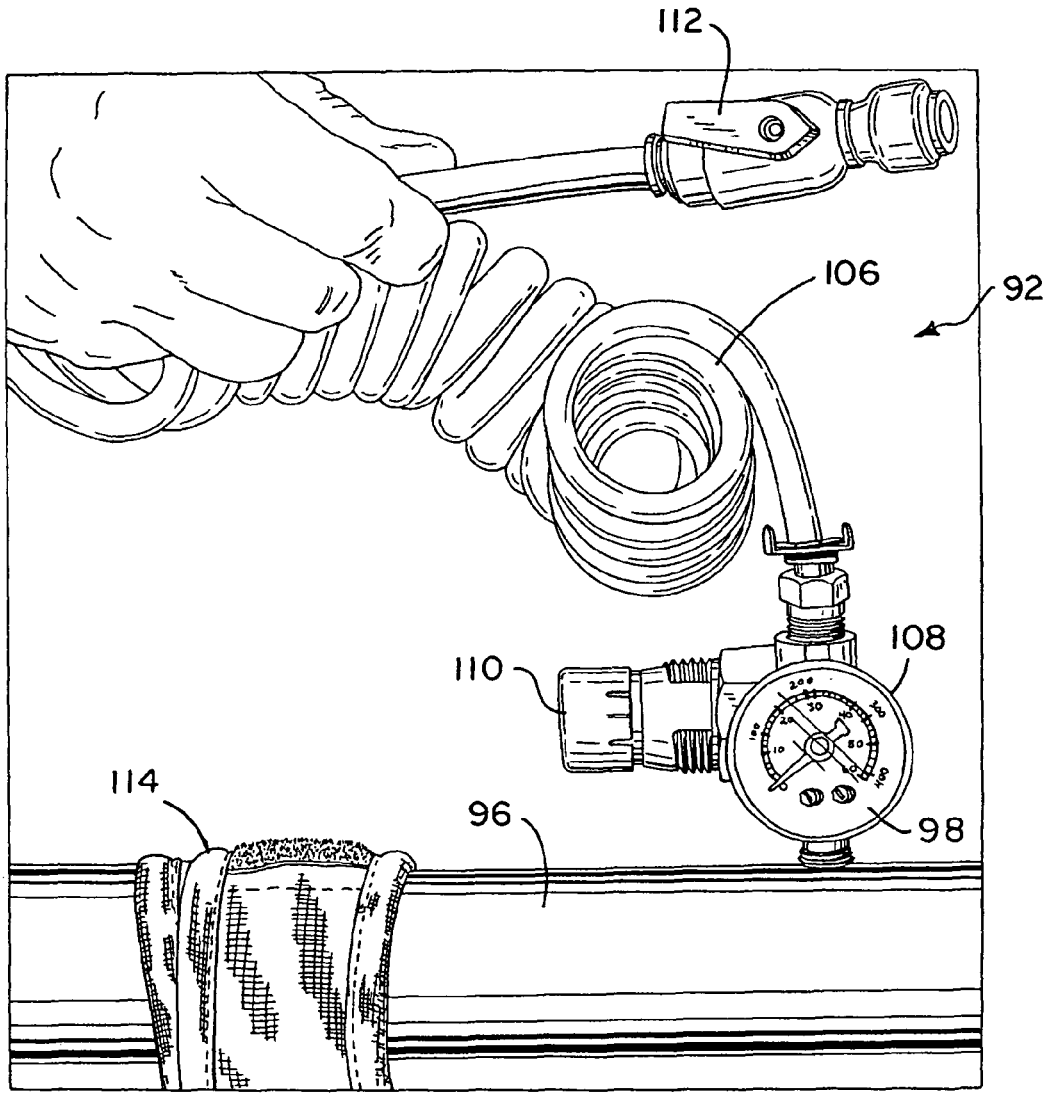
FIG. 11 is a perspective view of an exemplary individual air supply tube assembly of the type shown in FIG. 9.

FIG. 10 shows an exemplary construction of an air distribution manifold 88. FIG. 11 shows an exemplary individual air supply hose assembly 92. The air distribution manifold 88 includes one or more end caps 94, one or more regulator sections 96, one or more pipe sections 100, and one or more end supply fittings 102. Alternatively, instead of or in addition to an end supply fitting 102, a T supply fitting 104 can be used to supply compressed air from the heat exchanger assembly 26 to the air distribution manifold 88.

Each regulator section 96 preferably includes one or more individual regulators 98. Each individual air supply hose assembly 92 preferably extends from a regulator 98 through a flexible coil hose section 106 to a shutoff valve 112. Each regulator 98 preferably includes a regulator gauge 108 and a regulator control knob 110. A suitable regulator 98 can be obtained from Parker Filtration of Cleveland, Ohio. The air distribution manifold 88 is preferably formed of ABS plastic components, which is a material strong enough to withstand at least 150 PSI air pressure. The effective cross section of the air distribution manifold is preferably large enough to handle the flow rate of the compressed air coming out of the heat exchanger assembly 26, for example 185 CFM.

Figure 12:
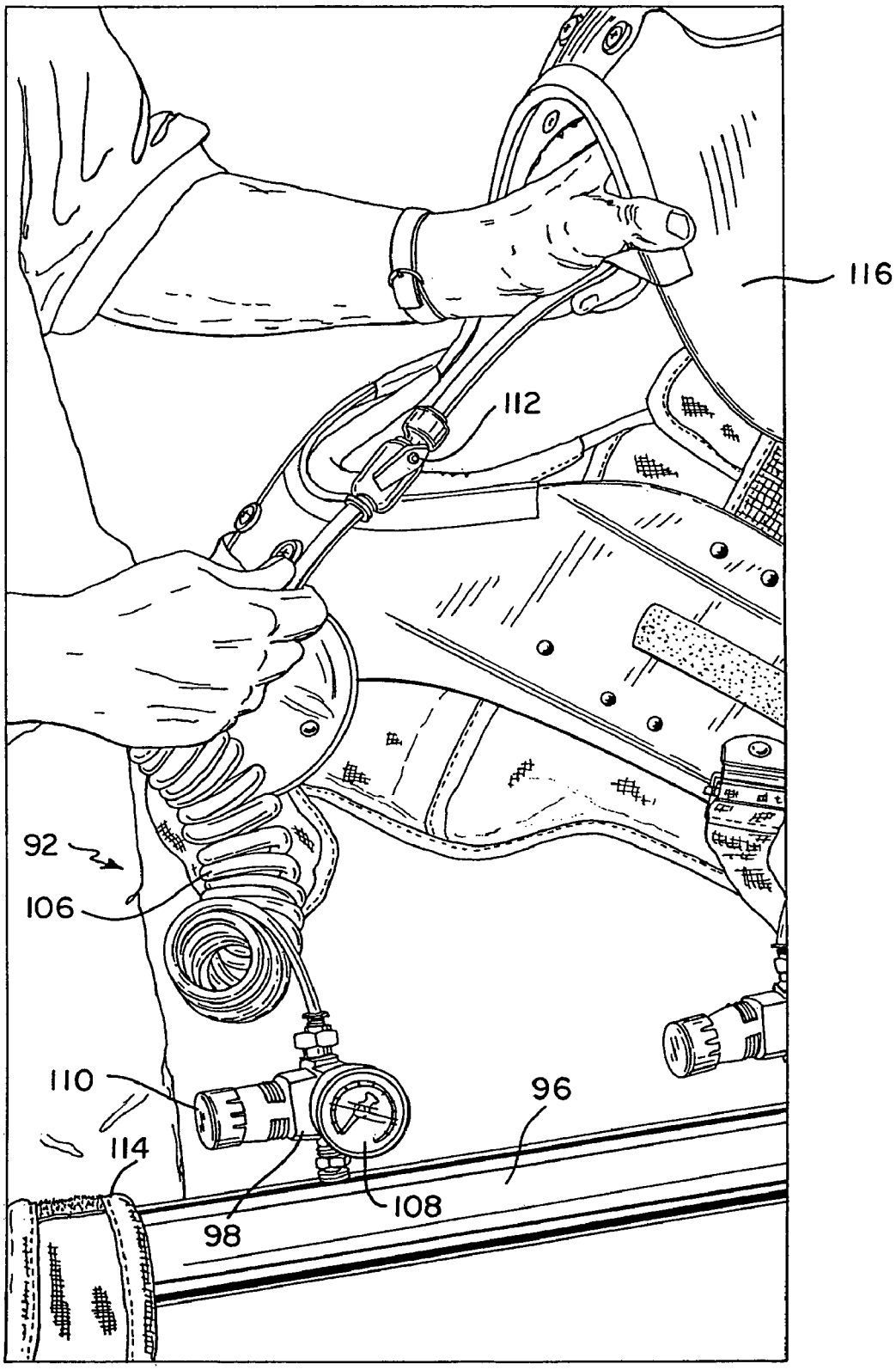
FIG. 12 is a perspective view of the exemplary individual air supply tube assembly of FIG. 11 connected to exemplary protective gear.

FIG. 12 shows how the exemplary individual air supply hose assembly 92 can be coupled to protective gear 116. As shown in FIG. 12, an individual player or athlete can attach the individual air supply hose 92 to his protective gear 116 whereby heated or cooled compressed air can be circulated through the protective gear 116 in order to cool or warm the athlete while the athlete rest between plays.

It is important to note that the construction and arrangement of the elements of the device 20 as shown in the exemplary embodiment discussed herein is illustrative only. Those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the invention.

Further, while the exemplary application of the device is in the field of athletics, the invention has a much wider applicability. For example, the invention can be adapted for athletic, military, aerospace, construction, or industrial environments where heating and/or cooling of the human body is desirable. Although the preferred embodiment uses ice to provide cooling, an active device such as a refrigeration device could be used in applications where ice is not readily available or when water must be conserved. Although the preferred embodiment uses electric heating elements to provide heating, other sources of heat could be used such as a gas flame or solar heat. Although the preferred embodiment uses water as a heat transfer medium to surround the heat exchange coils, other fluids such as conventional automotive anti-freeze could be used when appropriate, for example when self-contained operation is desirable or necessary.

In the exemplary embodiment, the heat exchanger enclosure encloses an interior that is approximately rectangular in shape. In general, a rectangular enclosure includes a floor, a lid, and a plurality of side walls extending between the floor and the lid. However, it is not required that the interior is rectangular, and other shapes could be used. Further, any such floor, lid, or wall is not necessarily planar, and could, for example, include convex, concave, rounded, ridged, or textured surfaces. Thus, the term "enclosure" used in the claims should be understood to encompass any surface or structure substantially or completely enclosing an interior space, irrespective of the orientation, position, or shape of that surface.

The particular materials used to construct the exemplary embodiments are also illustrative. For example, although the heat exchange tubing in the exemplary embodiment is preferably made of copper metal, other metals or other materials having suitable thermal conductivity and durability could be used. All such modifications, to materials or otherwise, are intended to be included within the scope of the present invention as defined in the appended claims.

The order or sequence of any process or method steps may be varied or re-sequenced according to alternative embodiments. Other substitutions, modifications, changes and/or omissions may be made in the design, operating conditions and arrangement of the preferred and other exemplary embodiments without departing from the spirit of the present invention as expressed in the appended claims.

The components of the invention may be mounted to each other in a variety of ways as known to those skilled in the art. As used in this disclosure and in the claims, the term mount includes join, unite, connect, associate, hang, hold, affix, attach, fasten, bind, paste, secure, bolt, screw, rivet, solder, weld, and other like terms. The term cover includes envelop, overlay, and other like terms.

The flow of compressed air through a device according to the invention can be directed in a variety of ways as known to those skilled in the art. As used in this disclosure and in the claims, the phrase "operatively connected for flow of compressed air" means to connect, directly or indirectly via a conduit, pipe, duct, tube, hose, or similar structure so that at least a portion of the compressed air flows between two points.

It is understood that the invention is not confined to the embodiments set forth herein as illustrative, but embraces all such forms thereof that come within the scope of the following claims.

What is claimed is:

1. A system for producing heated or cooled compressed air, comprising:

an air compressor having an output port;

a first air filter having an input port and an output port, wherein the output port of the air compressor is operatively connected for flow of compressed air to the input port of the first air filter;

a heat exchanger enclosure having an interior within the heat exchanger enclosure and an exterior outside the heat exchanger enclosure;

a heat exchange tubing positioned in the interior of the heat exchanger enclosure, the heat exchange tubing having an input port extending from the interior of the heat exchanger enclosure to the exterior of the heat exchanger enclosure, the heat exchange tubing having an output port extending from the interior of the heat exchanger enclosure to the exterior of the heat exchanger enclosure, and the heat exchange tubing having a middle portion operatively connected for flow of compressed air from the input port of the heat exchange tubing to the output port of the heat exchange tubing, wherein the output port of the first air filter is operatively connected for flow of compressed air to the input port of the heat exchange tubing;

a second air filter having an input port and an output port, wherein the output port of the heat exchange tubing is operatively connected for flow of compressed air to the input port of the second air filter;

an output manifold having an input port and a plurality of output ports, wherein the output port of the second air filter is operatively connected for flow of compressed air to the input port of the output manifold and wherein the input port of the output manifold is operatively connected for flow of compressed air to each output port of the output manifold; and at least one of protective gear or a garment releasably coupled to at least one of the plurality of output ports, wherein the at least one of the plurality of output ports is configured to supply the compressed air to the at least one of protective gear or the garment.

2. The system of claim 1, further comprising ice positioned within the heat exchanger enclosure to surround at least a portion of the heat exchange tubing, whereby compressed air flowing through the heat exchange tubing can be cooled by the ice.

3. The system of claim 1, further comprising water positioned within the heat exchanger enclosure to surround at least a portion of the heat exchange tubing, and a heating element positioned to heat the water, whereby compressed air flowing through the heat exchange tubing can be warmed by the water.

4. The system of claim 1, wherein the heat exchanger enclosure is an insulated box, and wherein the heat exchanger enclosure includes one or more wheels.

5. The system of claim 4, wherein the heat exchanger enclosure includes an openable lid and at least one drain.

6. The system of claim 1, wherein the second air filter provides finer filtration than the first air filter.

7. The system of claim 6, wherein the first air filter and the second air filter are of the coalescing type.

8. The system of claim 1, further comprising at least one regulator operatively connected for flow of compressed air from one of the plurality of output ports.

9. The system of claim 8, further comprising at least one individual air supply hose assembly operatively connected for flow of compressed air from the at least one regulator and comprising at least one shutoff valve and at least one hose section formed of coiled flexible plastic hose.

10. The system of claim 1, wherein the at least one of protective gear or a garment is configured to be worn by a person, the at least one of protective gear or a garment is configured to transfer thermal energy to or from the compressed air thereby heating or cooling the person.

11. The system of claim 10, wherein the at least one of protective gear or a garment is configured to circulate the compressed air through the at least one of protective gear or a garment.

12. The system of claim 1, wherein the middle portion of the heat exchange tubing comprises at least one bypass tube having a bypass valve, wherein the middle portion of the heat exchange tubing is operatively connected for flow of compressed air from the input port of the heat exchange tubing to the output port of the heat exchange tubing through the bypass tube, and wherein the bypass tube is positioned within the interior of the heat exchanger enclosure.

* * * * *